United States Patent [19]

Wong et al.

[11] Patent Number: 4,848,357

[45] Date of Patent: Jul. 18, 1989

[54] NERVE ENDING THERAPEUTICAL DEVICE

[76] Inventors: Jan L. Wong, No. 116, Feng Yuean Rd., Kao Shu Tsun, Kao Shu Hsiang, Ping-Tung Hsien; Ruey F. Jong, No. 12, Chang Jung Rd., Chang Jung Tsun, Kao Shu Hsiang, Ping-Tung Hsien, both of Taiwan

[21] Appl. No.: 135,717

[22] Filed: Dec. 21, 1987

[51] Int. Cl.[4] ..... A61H 39/00

[52] U.S. Cl. ..... 128/735; 128/741; 128/907

[58] Field of Search ..... 128/734–735, 128/741, 744, 907, 421, 419, 420 R, 423 R

[56] References Cited

U.S. PATENT DOCUMENTS 3,830,226 8/1974 Staub et al. ..... 128/741

4,112,923 9/1978 Tomecek ..... 128/734 X 4,408,617 10/1983 Auguste ..... 128/735

4,537,573 8/1985 Sunada ..... 128/735 X

*Primary Examiner*—Kyle L. Howell

*Assistant Examiner*—Angela D. Sykes

*Attorney, Agent, or Firm*—Bacon & Thomas

[57] ABSTRACT

A nerve ending therapeutical device containing a testing circuit, an oscillating circuit, a handle and a probe. The therapeutical device has a switch on the probe to control the location of a nerve ending first. Then the switch is set to another position, and the therapeutical device sends an electrical signal to attain therapeutical effect. Another switch is also provided for controlling the electrical signal to be either positive, in the "DRAW" mode, or negative in the "SUPPLEMENT" mode.

3 Claims, 2 Drawing Sheets

NERVE ENDING THERAPEUTICAL DEVICE

BACKGROUND OF THE INVENTION

The present invention relates to a nerve ending therapeutical device, and more specifically, to a therapeutical device which utilizes electronic means to stimulate nerve endings of the human body.

The prior art of this device uses the method of so-called electrical therapy, which applies a high voltage on nerve endings of the human body, thereby stimulating internal secretion of the human body so that one's vigor is restored and therapeutical effect are achieved.

In the conventional electrical therapy, a current of certain frequency is used. For example, a 60 HZ current is used in threating ordinary skin diseases. The magnitude and frequency of current should be adjusted according to the actual situation, e.g. a baby's impedance being lower than an adult's therefore a lower current should be applied. Electrical probes with proper magnitude and frequency of current are put on the nerve endings of the human body. The polarity of the current applied thereon is choosen based on the principle of supplementing or drawing (stimulation or repression), to neutralize the polarity carried by the specified disease. For instance, when treating an inflammatory disease, the infected part is in excess of negative electric ions and thus should be neutralized with positive ions, or called "drawing"; whereas it is called "supplementing" if applied with negative ions. It is by this mode of operation that the therapeutical effect is achieved.

However, the electrical therapeutical device of prior art has the following drawbacks:

1. Since it is only capable of adjusting the magnitude and frequency of the current applied, it is necessary to use another device to detect the required nerve endings before the therapeutical device can be operated. So it is troublesome in treating and may cause wrong detection of nerve endings.
2. It can only provide a single frequency of current or a continuously varying frequency of current, thus the therapeutical effect is lessened.
3. It provide the operation of supplementing or the operation of drawing. When using it to make treatment, it make cause the disease even worse if the mode of operation is used wrongfully.

SUMMARY OF THE INVENTION

It is the purpose of this present invention to obviate the above-mentioned drawbacks in the manner set forth in the detailed description of the preferred embodiment.

A primary object of this invention is to provide as nerve ending therapeutical device which uses variable frequency of signal and continuously adjustable current to make the therapeutical effect most effective.

Another object of the present invention is to provide a nerve ending therapeutical device which provide the same effect of acupuncture but uses the method of induction instead of the needle.

Further object and advantages of the present invention will become apparent as the follwing description proceeds.

DETAILED DESCRIPTION OF THE PREFERRED EMBODIMENT

Figure 1:
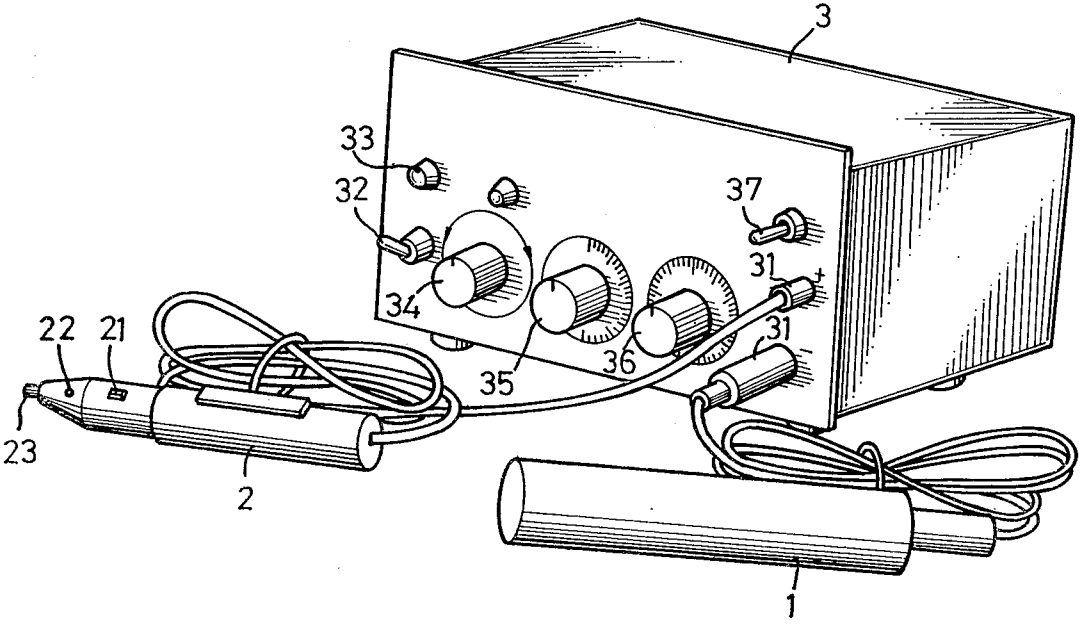
FIG. 1 is a perspective view of a nerve ending therapeutical device in accordance with the present invention.

Referring to FIG. 1, it can be seen that this invention consists of an encasement 3, a handle 1 connected to an output terminal 31 and a probe 2. The encasement 3 contains an oscillating circuit necessary for the therapy. A power switch 32 is installed on the front surface of the encasement 3 with a neon lamp 33 above the power switch 32 to indicate the on-off state of the power and the working condition of the oscillating circuit. Three adjusting knobs 34, 35 and 36 are also arranged on the front face of the encasement 3 to control current magnitude, output frequency and testing sensitivity, respectively. In addition, a control switch 37 is disposed which is used to set the output signal to be as one of three modes "supplement", "draw" or "automatic". The output terminal 31 has two output points which are connected to the probe 2 and handle 1 respectively. The handle 1 can be grasped by one's hand, and the probe 2 is disposed a switch 21 and an illuminator 22. The switch 21 can be switched to choose either to test nerve (TEST position) endings or to be used therapeutically (THERAPY position). At the end of the probe 2 there is a tip 23 which can be pressed on the skin of the human body for therapeutical purposes.

To use this invention, the switch 21 of the probe 2 is set to the testing position, then the tip 23 is pressed upon around the area where the nerve ending should be found. The probe 2 is moved around to find the exact location of the desired nerve ending. When the exact location is touched, the illuminator will twinkle indicating the nerve ending has been found. Then the switch 21 can be switched to the THERAPY position and the oscillating circuit inside the encasement 3 sends a signal out of the tip 23 of the probe 2. The sensitivity adjustment 34 is to be adjusted according to the resistance of the human body being treated. Thus, it can be seen that this invention has combined the testing and therapeutical functions instead of having to use two different machines to achieve the same purpose.

Furthermore, this invention provides an induction-type therapeutical device. By attaching the probe 2 to a nerve ending of the human body while grasping the handle 1 with one's hand, the electrical signal is transmitted through the human body by way of the probe 2 and returns to the oscillating circuit within the encasement 3 via the handle 1. Thus this invention provides a device which has therapeutical effects similar to those which acupuncture offers but does not require the use of a needle to hurt the person being threated.

Figure 2:
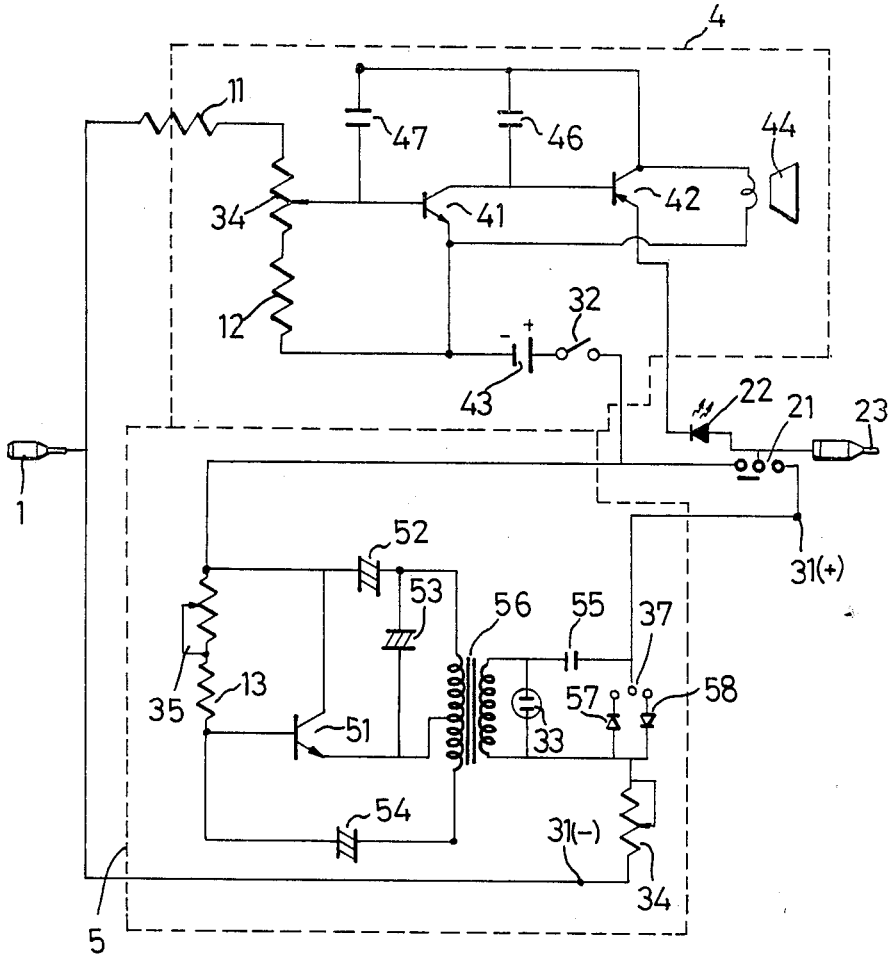
FIG. 2 is a circuit diagram of the nerve ending therapeutical device in accordance with the present invention.

Now referring to FIG. 2, it is shown that the circuit diagram contains mainly a testing circuit 4 and a boosting oscillating circuit 5. The testing circuit 4 comprises: transistors 41, 42; capacitors 46, 47; a speaker 44 and an external illuminator light emitting diode 22 forming a positive feedback circuit. The speaker 44 emits a certain frequency of sound and the illuminator light emitting diode 22 twinkles upon actuation, thereby providing audio and video effects to locate the desired nerve ending. The triggering function is provided by the base of transistor 41 and a variable resistor of the adjusting knob 34 and the metal part of the handle 1. A dry battery power supply 43 is connected to two branches via a power switch 32. One of the branches is connected to the oscillating circuit 5. The other branch is connected the tip 23 of the probe 2 and the "+" terminal of the output terminals 31 by way of a three-contact switch 21 of the probe 2. When the three-contact switch 21 is set to its normal-closed contact as the figure indicates, the impedance of an object between the probe tip 23 and the handle 1 determine if the testing circuit will function. Since the impedance of nerve ends is lower than other parts of the human body, the speaker will sound and the light emitting diode will illuminate when the probe 2 touches the exact location of a nerve ending. After the nerve ending has been found, the three-contact switch 21 can be switched to the therapy position to for therapeutical purposes.

A D.C. Voltage from the power supply is applied into the oscillating circuit 5. A transistor 51, capacitors 52, 53, 54 and a boosting transformer 56 forms a positive feedback circuit and output oscillating signals. The oscillating signal is boosted by the boosting transformer 56 and the frequency of said signal is determined by adjusting the variable resistor 35, ranging from 0–60 HZ. Further, the waveform of the output oscillating signal is composed of two frequencies, one part of the waveform being in a certain frequency and the other part thereof being in another frequency. Thus, instead of treating only one disease at a certain time in the usual situation of using the prior art, this invention provides the capability of treating two diseases at the same time.

A neon lamp illuminator 33 is shunt with the output coil of the boosting transformer 56, indicating the oscillating circuit is normal. One end of the output coil of the boosting transformer is further connected to the handle 1 via a variable resistor 36, and the other end of the same is coupled to the switch 21 of the probe 2 by way of a direct-current blocking capacitor 55 and a supplementing and draining control circuit. When the switch 21 is switched to the position connecting the tip 23 to the output coil of the transformer 56, the tip 23 will send an electrical signal which can make the electron distribution of the circulation system of the human body achieve equilibrium and stimulate the internal secretion thereby providing therapeutical effects.

As to the supplementing and drawing control circuit, it is fundamentally a clamping circuit composing two diodes 57, 58 and a control switch 37. The control switch 37 has three contacts. When the control switch 37 is at the left position and therefore connects with the diode 57, the negative portion of the output signal is clamped and only the positive portion of the signal is output, then the invention is in "draw" mode. If the control switch 37 is set to the right position, and only the negative portion of the signal is output, then the invention is "supplement" mode.

It is worth mentioning that if the disease being treated cannot be distinguished, then the control switch 37 can be set at the middle position thereby achieving the supplementing and drawing function simultaneously.

Moreover, the power supply of this invention is provided by a dry battery thus avoiding the non-portability and danger of leakage of the conventional prior art.

I claim:

1. A nerve ending therapeutical device comprising a testing circuit (4), an oscillating circuit (5), a handle (1) and a probe (2), wherein said testing circuit (4) is an audio oscillating circuit which is connected with a speaker (44) and an illuminator (22) such that said speaker (44) and illuminator (22) sound and twinkle respectively when said testing circuit (4) is activated, said testing circuit (4) being connected with a metal part of said handle (1) via a variable resistor (34);

a power supply being connected to said oscillating circuit (5) and a normally-closed contact of a switch (21) of said probe (2) separately, a middle contact of said switch (21) (21) being connected to a metal part of said probe (2) in addition to being connected to an output of said testing circuit (4) via said illuminator (22); a normally-open contact of said switch (21) being connected to an output of said oscillating circuit (5);

said oscillating circuit (5) including a positive feedback circuit with a variable resistor (35) for adjusting output frequency and a boosting transformer (56), outputs of said transformer (56) being coupled to said handle (1) and said switch (21) of said probe (2) respectively, whereby by means of switching said switch (21) of said probe (2) to said normally closed contact, the location of a nerve ending can be found, and then said switch (21) is set to said normally-open contact.

2. An nerve ending therapeutical device of claim 1, wherein said output of said oscillating circuit (5) is in series with a variable resistor (31) thereby enabling an adjustment of an output current.

3. An nerve ending therapeutical device of claim 1, wherein said output of said oscillating circuit (5) is shunt with a clamping circuit for controlling a supplementing and a draining function, said clamping circuit being composed of a three contact switch (37) and two diodes (57), (58).

* * * * *